US007153182B1

(12) United States Patent
Taylor et al.

(10) Patent No.: US 7,153,182 B1
(45) Date of Patent: Dec. 26, 2006

(54) SYSTEM AND METHOD FOR IN SITU CHARACTERIZATION AND MAINTENANCE OF POLISHING PAD SMOOTHNESS IN CHEMICAL MECHANICAL POLISHING

(75) Inventors: Travis R. Taylor, Fremont, CA (US); Jingang Yi, Albany, CA (US); Peter Richard Norton, Emeryville, CA (US)

(73) Assignee: Lam Research Corporation, Fremont, CA (US)

( * ) Notice: Subject to any disclaimer, the term of this patent is extended or adjusted under 35 U.S.C. 154(b) by 117 days.

(21) Appl. No.: 10/955,044

(22) Filed: Sep. 30, 2004

(51) Int. Cl.
*B24B 49/00* (2006.01)

(52) U.S. Cl. ..... 451/5; 451/10; 451/11; 451/303; 451/307

(58) Field of Classification Search ..... 451/5, 451/8, 9, 10, 11, 41, 59, 299, 303, 307
See application file for complete search history.

(56) References Cited

U.S. PATENT DOCUMENTS

| | | | |
|---|---|---|---|
| 4,793,895 | A | 12/1988 | Kaanta et al. |
| 5,078,801 | A | 1/1992 | Malik |
| 5,240,552 | A | 8/1993 | Yu et al. |
| 5,265,378 | A | 11/1993 | Rostoker |
| 5,272,117 | A | 12/1993 | Roth et al. |
| 5,308,438 | A | 5/1994 | Cote et al. |
| 5,321,304 | A | 6/1994 | Rostoker |
| 5,329,732 | A | 7/1994 | Karlsrud et al. |
| 5,409,544 | A | 4/1995 | Ota et al. |
| 5,433,651 | A | 7/1995 | Lustig et al. |
| 5,527,423 | A | 6/1996 | Neville et al. |
| 5,558,568 | A | 9/1996 | Talieh et al. |
| 5,593,344 | A | 1/1997 | Weldon et al. |
| 5,668,063 | A | 9/1997 | Fry et al. |
| 5,692,947 | A | 12/1997 | Talieh |
| 5,722,877 | A | 3/1998 | Meyer et al. |
| 5,762,536 | A | 6/1998 | Pant et al. |
| 5,800,248 | A | 9/1998 | Pant et al. |
| 5,916,012 | A | 6/1999 | Pant et al. |
| 5,944,580 | A | 8/1999 | Kim et al. |
| 5,980,368 | A | 11/1999 | Chang et al. |
| 6,186,865 | B1 | 2/2001 | Thornton et al. |

(Continued)

FOREIGN PATENT DOCUMENTS

| | | |
|---|---|---|
| WO | WO 85/04486 | 10/1985 |

OTHER PUBLICATIONS

Chingfu Lin, Shie-Sen Peng, Hsin Chu, "Pad Temperature As An End Point Detection Method in WCMP Process," 1998 CMP MIC Conference, Feb. 19-20, 1998, pp. 52-56.

(Continued)

*Primary Examiner*—Eileen P. Morgan
(74) *Attorney, Agent, or Firm*—Brinks Hofer Gilson & Lione

(57) ABSTRACT

A system and method for in situ measurement and maintenance of preferred pad smoothness in a CMP process is disclosed. The system includes a linear polisher having one or more sensors for detecting fluid pressure, fluid flow or motor current at the linear polisher during a polishing process. A controller receiving the information provided by the sensors includes an algorithm for adjusting the pad conditioning process to achieve a desired pad smoothness based on the sensor data. The method includes obtaining baseline data on preferred linear polisher characteristics associated with desired pad smoothness and using the baseline data to adjust a pad conditioning regimen on a linear polisher to achieve the desired pad smoothness in situ.

7 Claims, 5 Drawing Sheets

U.S. PATENT DOCUMENTS 6,325,706 B1 * 12/2001 Krusell et al. ..... 451/296

OTHER PUBLICATIONS

"Zeta Potential: A Complete Course in 5 Minutes," Zeta-Meter, Inc. brochure, pp. 1-8.

"Coulter Delsa 440 SX, Zeta Potential and Particle Size," Coulter International Corp., 1996-1998, pp. 1-3.

D.H. Everett, Basic Principles of Colloid Science, Chapter 6, "Some Important Properties of Colloids I Kinetic Properties," Royal Society of Chemical Paperbacks, Thomas Graham, Cambridge, CB4 4WF, pp. 76-79 and 88-91.

Denny A. Jones—2nd ed., Principles and Prevention of Corrosion, Chapter 2, "Thermodynamics and Electrode Potential," ISBN 0-13-359993-0, Prentice-Hall International, 1996.

Diane Hymes, Igor Malik, Jackie Zhang, Ramin Emami, "Brush scrubbing emerges as future wafer-cleaning technology," Solid State Technology, 0038-111X, Jul. 1997, pp. 209-214.

Brad Withers, Eugene Zhao, Wilbur Krusell, Rahul Jairath, "Wide Margin CMP for STI," Solid State Technology, Jul. 1196, pp. 173-179.

D.R. Crow, 4th ed., Principles and Applications of Electrochemistry, ISBN 0 7514 0158 4 (PB), Blackie Academic and Profressional, 1994, pp. 76-77.

R.J. Gutmann, D.T. Price, J.M. Neirynck, C. Sainio, D. Permana, D.J. Duquette and S.P. Murarka, "CMP of Copper-Polymer Interconnect Structures," CMP-MIC Conference, 1998 IMIC-300P/98/0257, Feb. 19-20, 1988, pp. 257-266.

* cited by examiner

SYSTEM AND METHOD FOR IN SITU CHARACTERIZATION AND MAINTENANCE OF POLISHING PAD SMOOTHNESS IN CHEMICAL MECHANICAL POLISHING

FIELD OF THE INVENTION

The present invention relates to the field of semiconductor wafer processing. More specifically, this invention relates to determining or maintaining, in situ, a desired smoothness of a polishing pad used to planarize semiconductor wafers.

BACKGROUND

Semiconductor wafers are typically fabricated with multiple copies of a desired integrated circuit design that will later be separated and made into individual chips. A common technique for forming the circuitry on a semiconductor is photolithography. Part of the photolithography process requires that a special camera focus on the wafer to project an image of the circuit on the wafer. The ability of the camera to focus on the surface of the wafer is often adversely affected by inconsistencies or unevenness in the wafer surface. This sensitivity is accentuated with the current drive toward smaller, more highly integrated circuit designs. Semiconductor wafers are also commonly constructed in layers, where a portion of a circuit is created on a first level and conductive vias are made to connect up to the next level of the circuit. After each layer of the circuit is etched on the wafer, an oxide layer is put down allowing the vias to pass through but covering the rest of the previous circuit level. Each layer of the circuit can create or add unevenness to the wafer that is preferably smoothed out before generating the next circuit layer.

One of the methods for achieving planarization of the surface is chemical mechanical polishing (CMP). CMP is a technique in which a chemical slurry is used along with a polishing pad to polish away materials on a semiconductor wafer. The mechanical movement of the pad relative to the wafer, in combination with the chemical reaction of the slurry disposed between the wafer and the pad, provide the abrasive force with chemical erosion to planarize the exposed surface of the wafer (typically, a layer formed on the wafer), when the wafer is pressed onto the pad. Available CMP systems, commonly called wafer polishers, often use a rotating wafer holder that brings the wafer into contact with a rotary polishing pad moving in the plane of the wafer surface to be planarized. The polishing fluid, such as a chemical polishing agent or slurry containing microabrasives, is applied to the polishing pad to polish the wafer. The wafer holder then presses and rotates the wafer against the rotating polishing pad to polish and planarize the wafer.

Another system used for performing CMP to obtain an effective polishing rate involves linear planarization technology. Instead of a rotating pad, a moving belt is used to linearly move the pad across the wafer surface. The wafer is still rotated for averaging out the local variations, but the planarization uniformity is improved over CMP tools using rotating pads, partly due to the elimination of unequal radial velocities. One example of such a linear polisher is described in U.S. Pat. No. 5,692,947. Unlike the hardened table top of a rotating polisher, linear planarizing tools use linearly moving belts that are integrated with polishing pad material or upon which the pad is disposed. The ability for the belt to flex can cause a change in the pad pressure being exerted on the wafer. When the pressure of the wafer-pad engagement can be controlled, it provides a mechanism for adjusting the planarization rate and/or the polishing profile across the surface of the wafer. A support, such as a fluid platen, can be placed under the belt for use in adjusting the pad pressure being exerted on the wafer. An example of a fluid platen is disclosed in U.S. Pat. No. 5,558,568.

When CMP is employed, it is generally advantageous to monitor the effects of the planarizing process to determine if the process is being performed according to desired specifications. One significant challenge in CMP processing is the ability to process each wafer of a particular type in the same way as all other wafers of that type. In other words, it is a goal of CMP to characterize and maintain a polishing environment for each wafer so that there is substantially no variation in planarization characteristics from one wafer to the next.

In CMP there are several methodologies for determining in situ removal rate and, in some cases, in situ uniformity. There are difficulties, however, in measuring pattern wafer metrics, such as dishing or erosion, in situ. These process performance metrics are generally dependent on the consumables used in the CMP process and their characteristics. Accordingly there is a need for an improved method and system for determining CMP pattern wafer performance.

SUMMARY

In order to address the need described above, a method and system for in situ characterization and maintenance of polishing pad smoothness is described below. The system includes at least one feedback line carrying in situ linear polisher performance data from the linear polisher and a controller in communication with the at least one feedback line and operative to determine a pad smoothness of the polishing pad based on the performance data on the at least one feedback line.

In different embodiments, the linear polisher may include a belt movably mounted on at least one roller, wherein a roller motor rotatably drives the at least one roller. A platen is disposed underneath the belt that is configured to dispense a fluid bearing between the platen and the belt, where the belt includes a polishing pad positioned on a side of the belt facing away from the platen. A flow meter may be used to monitor a flow rate of fluid to the platen and a sensor in communication with the fluid bearing may measure a pressure of the fluid while a material is polished. The controller may be in communication with one or more pressure sensors adjacent to the fluid bearing, the flow meter and the roller motor and configured to determine the polishing pad smoothness from pad smoothness information, where the pad smoothness information includes at least one of roller motor current sensed at the roller motor, fluid flow rate sensed at the flow meter or pressure sensed at the fluid bearing.

According to another aspect of the invention, a method is disclosed for maintaining a pad smoothness of a polishing pad in a linear polisher, the method includes first determining a target operating range of at least one parameter of the linear polisher having a first polishing pad of a particular pad type, a first pad conditioner of a particular pad conditioner type and used with a first wafer of a particular wafer type, where the target operating range of at least one of the parameters corresponds to a desired polishing pad smoothness. The one or more parameters are then monitored in situ while polishing a second wafer of the particular wafer type on the linear polisher. The first polishing pad is then conditioned with the first conditioner if the monitored parameters are within the target operating range so that the desired polishing pad smoothness is maintained and the dishing on the wafer, associated with the pad smoothness, is kept within desired limits.

In various embodiments, the parameters monitored and responded to may include one or more of fluid flow to a fluid platen, pressure at the fluid platen or motor current to a roller motor of the linear polisher. Additionally, the same target operating range, once determined for a particular pad type, a particular pad conditioner type and a particular wafer type may be used to maintain pad smoothness, and thus dishing performance, for any replacement polishing pad, polishing pad conditioner or wafer of the same type. Other features and advantages of the invention will become apparent to those of ordinary skill in the art upon review of the following drawings, detailed description and claims.

DETAILED DESCRIPTION OF THE PRESENTLY PREFERRED EMBODIMENTS

A method and apparatus for characterizing consumables used in chemical mechanical polishing (CMP), and monitoring and maintaining polishing pad performance in is described herein. As used herein, consumables refer to polishing pads, pad conditioners and other materials that are designed to be used up or worn out during the polishing process. In the following description, numerous specific details are set forth, such as specific structures, materials, tools, polishing techniques, and so on, in order to provide a thorough understanding of the present invention.

Figure 1:
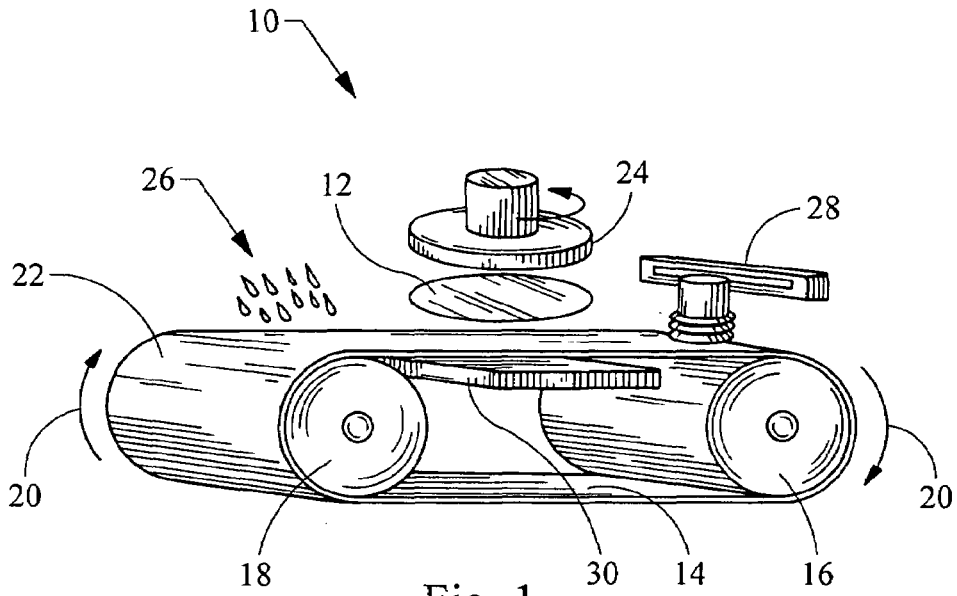
FIG. 1 is a perspective view of a linear polisher according to one embodiment of the present invention.

Referring to FIG. 1, one suitable linear polisher 10 for use in practicing embodiments of the present invention is shown. The linear polisher (also referred to as a linear planarization tool) 10 is utilized in planarizing a semiconductor wafer 12, such as a silicon wafer. Although CMP can be utilized to polish a base substrate, typically CMP is utilized to remove a material layer, such as a film layer, or a portion of the material layer deposited on the semiconductor wafer. Thus, the material being removed can be the substrate material of the wafer itself or one of the layers formed on the substrate. Formed layers include dielectric materials (such as silicon dioxide), metals (such as aluminum, copper or tungsten) and alloys, or semiconductor materials (such as silicon or polysilicon).

The linear polisher 10 of FIG. 1 utilizes a belt 14, which moves linearly with respect to the surface of a wafer 12. The belt 14 may be an endless belt, or a continuous strip, rotating about rollers (or spindles) 16 and 18, in which one or both rollers are driven by a driving means, such as a motor, so that the rotational motion of the rollers 16, 18 causes the belt 14 to be driven in a linear motion (as shown by arrow 20) with respect to the wafer 12. The belt 14 is typically made from a metallic material; however other woven or nonwoven belts made from materials other than metal are also contemplated. A polishing pad 22 is affixed onto, or formed integrally with, the belt 14 at its outer surface facing the wafer 12. The pad can be made from a variety of materials to have an abrasive or non-abrasive property depending on the type of process and slurry to be used.

The wafer 12 is detachably held by a wafer carrier 24, which is part of a polishing head. The wafer 12 is held in position by a mechanical retaining mechanism, such as a retainer ring, and/or by the use of vacuum. Generally, the wafer 12 is rotated while the belt/pad assembly moves in a linear direction to polish a layer on the wafer 12. A downforce is exerted on the wafer carrier 24 in order to engage the wafer onto the pad with some predetermined force. The linear polisher 10 also dispenses a slurry 26 onto the pad 22. A pad conditioner 28 is typically used in order to recondition the pad surface during use. Techniques for reconditioning the pad 22 are known in the art and often involve scratching the pad with an abrasive-coated puck in order to remove the residue build-up caused by the used slurry and waste material generated in the CMP process. In other embodiments, such as with pads having a fixed abrasive, a non-abrasive conditioner may be used.

A support is disposed on the underside of the belt 14 and opposite from the wafer 12, so that the belt/pad assembly resides between the support and wafer 12. In one embodiment, the support may be a fluid platen 30 that generates a fluid bearing. Alternatively, the support may be a solid platform or may have mechanical bearings or rollers. A primary purpose of fluid platen 30 is to provide a supporting platform on the underside of the belt 14 to ensure that the pad 22 makes sufficient contact with wafer 12 for uniform polishing. When the belt 14 is depressed as the wafer is pressed downward onto the pad 22, the fluid platen 30 provides a counteracting support to this downward force.

In one embodiment, where the support is a fluid platen 30, the fluid flow from the fluid platen 30 can be used to control forces exerted onto the underside of the belt 14 and to reduce friction between the belt and the fluid platen. The fluid is generally air or liquid, although a neutral gas (such as nitrogen) can be used. Using fluid flow control, pressure variations exerted by the pad on the wafer can be adjusted to provide a more uniform polishing profile across the face of the wafer 12. Examples of fluid platens for generating fluid bearings in CMP processes are disclosed in U.S. Pat. Nos. 5,558,568 and 5,916,012, and the entirety of the disclosures of these patents are incorporated herein by reference.

Figure 2:
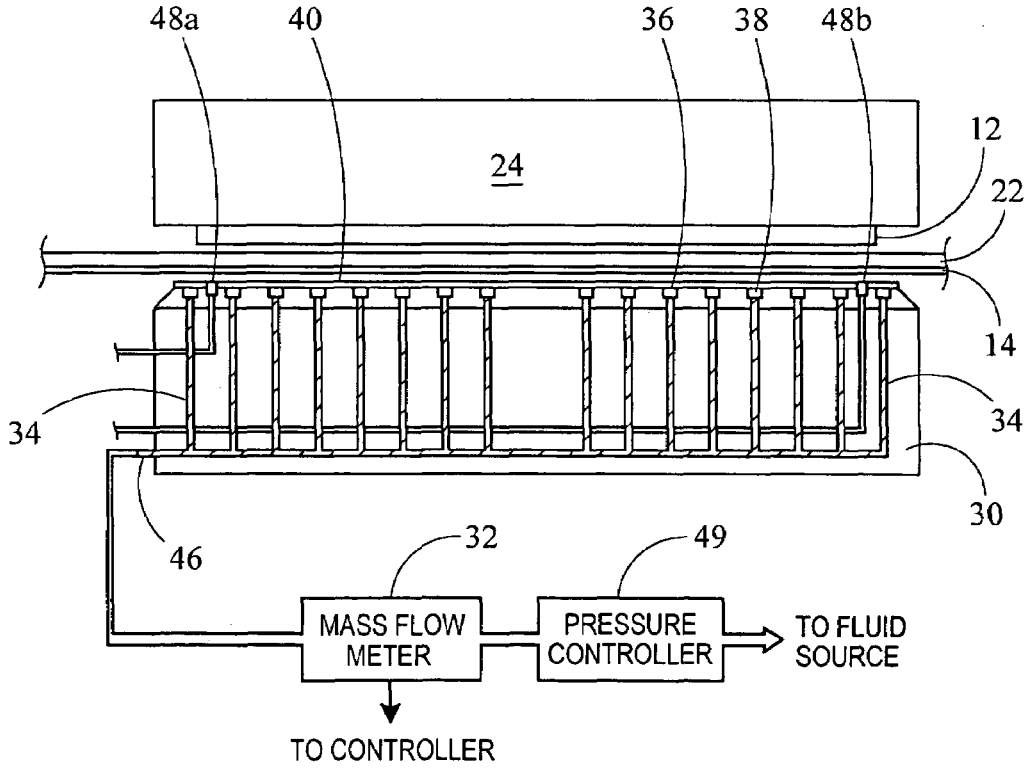
FIG. 2 is a cross-sectional view of a fluid platen positioned under a belt/pad assembly illustrating pressure sensors that are disposed along the underside of the belt/pad assembly.
Figure 4:
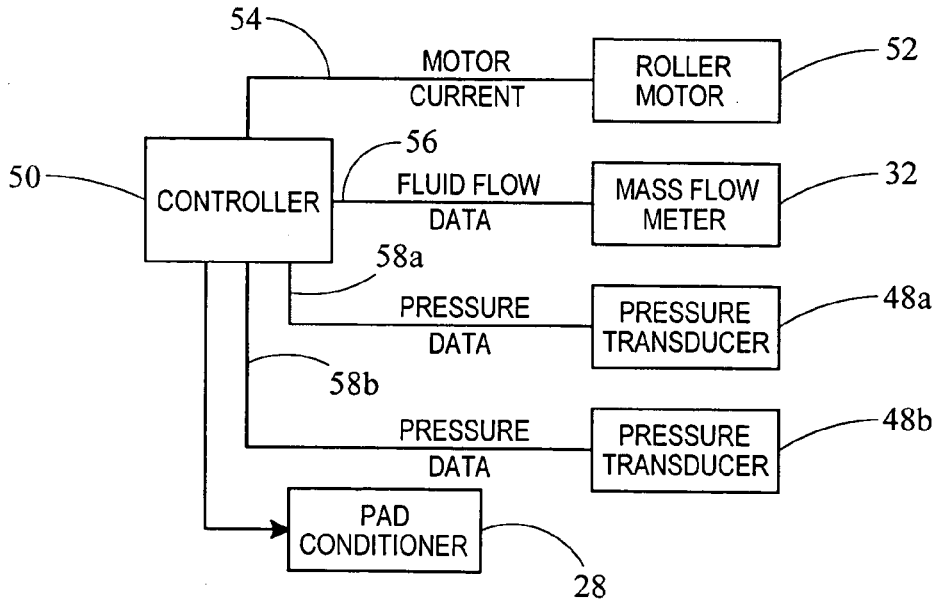
FIG. 4 is a diagram illustrating a linear polisher controller arrangement.

As shown in FIG. 2, fluid platen 30 is positioned under the wafer 12, but on the opposite side of the belt 14. The wafer carrier 24 exerts a downforce to engage the wafer 12 on the pad 22 while the fluid bearing produced by the fluid platen exerts an opposing force to the underside of the belt 14. A mass flow meter 32 measures the flow rate of fluid from a pressure controller 49 in fluid communication with a fluid source (not shown) to a manifold in the fluid platen 30. Information related to the measured fluid flow is fed back to a controller 50 (FIG. 4). The manifold then feeds a plurality of channels 34 distributed within the body of the fluid platen 30. Openings 36 are disposed along the upper surface of the fluid platen at the end of each channel. In some instances, the channels 34 open into corresponding concentric grooves 38 formed along the upper surface region of the fluid platen 30 so that fluid flow from a given opening 36 feeds fluid into the corresponding groove or grooves 38.

Figure 3:
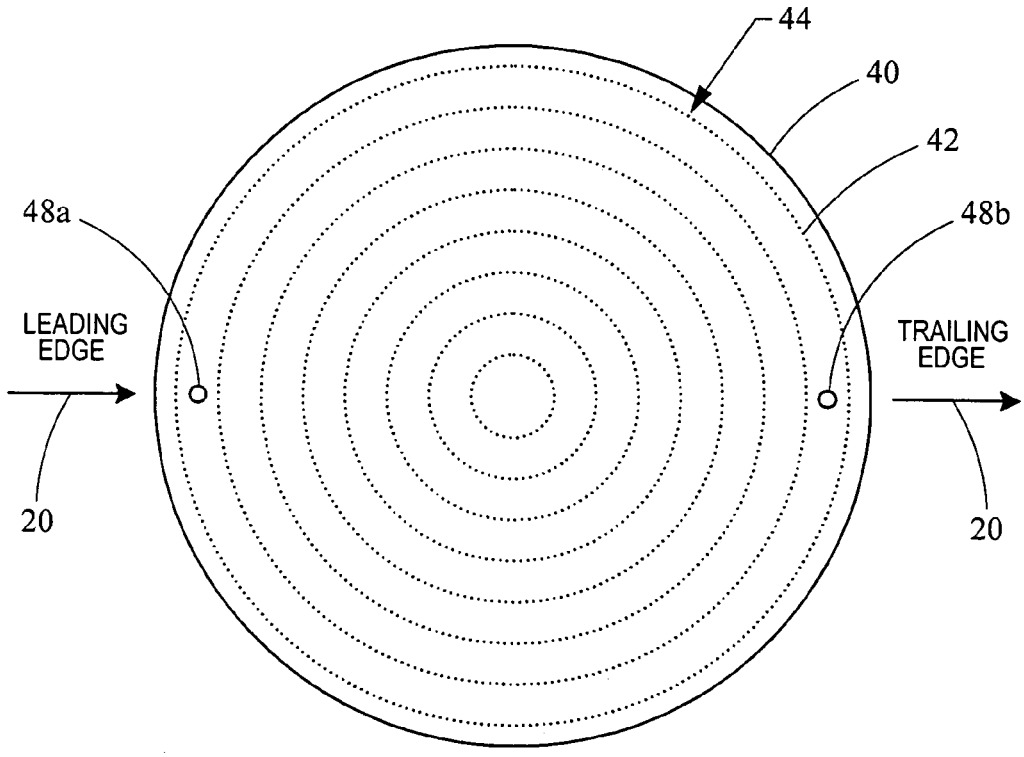
FIG. 3 is a top view of a fluid platen having concentric arrangement of fluid openings for use in generating a fluid bearing.

A cover plate (or insert) 40, also shown in FIG. 3, fits over the grooves 38. A plurality of openings 42, arranged in concentric rings 44, is distributed on the cover plate 40 so that each ring 44 coincides with a corresponding groove 38. Thus, in the example, the openings 42 of each concentrically arranged ring 44 are fed by fluid flow from the corresponding groove 38. A single inlet 46 is shown for feeding each of the channels 34. In other embodiments, the channels 34 may be coupled separately or in groups to separate inlets for individual (or group) flow control. Additionally, arrangements of openings on the cover plate 40 of the fluid platen other than the concentrically arranged openings 42 shown in FIG. 3 are contemplated. In one embodiment, a plurality of pressure controllers may feed fluid through the mass flow meter, each of the pressure controllers independently controlling pressure to a ring 44 or other arrangement of openings to provide separately controllable zones.

In FIGS. 2 and 3, two sensors 48*a*, 48*b* are shown disposed along the surface of the fluid platen 30. The exact number and placement of such sensors may be dependent on the type of parameters being measured or information being sought. One suitable type of sensor is a pressure sensor to measure the pressure exerted by the fluid bearing flowing between the fluid platen 30 and the underside of the belt 14. The sensors employed can measure a variety of parameters which can provide information relating to the on-going polishing process and any of a number of known types of sensors may be used. Applications of sensors in linear polishers are described in U.S. Pat. No. 5,762,536, the entirety of which is incorporated herein by reference The leading edge sensor shown in FIGS. 2 and 3 is labeled 48*a* and a trailing edge sensor is labeled 48*b*. The leading edge is defined as the edge of the wafer 12 first making contact with a point located on the linearly moving pad 22. The trailing edge is defined as the edge of the wafer 12 where the pad 22 disengages from the wafer. Thus, the leading edge sensor 48*a* is disposed near the edge where a point on the belt 14 first engages the fluid platen 30, while the trailing edge sensor 48*b* is located at the opposite edge of the platen 30 along the linear direction traveled by the belt 14.

In one embodiment, the sensors 48*a*, 48*b* are pressure sensors positioned to measure a pressure of the fluid between the belt and platen. During a polishing operation, the fluid platen disperses fluid and forms the fluid bearing. Because the belt 14 is within close proximity of the bearing surface, the area between the fluid platen and the underside of the belt 14 is also filled with the fluid bearing. The fluid bearing provides both a counterforce to the wafer downforce and a low friction contact area to allow ease of belt movement. Adequate fluid flow ensures that this space is filled with fluid, so that pressure sensors 48*a*, 48*b* will measure the pressure of the dispersed fluid.

As illustrated in FIG. 4, a control architecture is shown for use with the linear polisher of FIGS. 1–3. A controller 50 receives data from the mass flow meter 32, pressure transducers 48*a*, 48*b*, and a roller motor 52. The roller motor 52 is connected to one or both of the rollers 16, 18 controlling movement of the linear belt 14 and pad 22. The roller motor 52 may be any of a number of electric motors suitable for controlling the rollers of the linear polisher 10. A feedback channel 54 from the roller motor to the controller 50 carries information related to the current supply to the roller motor. A feedback channel 56 from the mass flow meter 32 carries fluid flow data to the controller. Similarly, pressure data channels 58A, 58B carry pressure data from the pressure transducers 48*a*, 48*b*, to the controller 50. Using one or more of these pieces of feedback information, the controller 50 provides control signals to the pad conditioner 28 to manage how much time the pad conditioner is applied to the pad, and how much pressure to apply to the pad conditioner when the pad conditioner engages the pad, in order to maintain a particular pad smoothness. The controller 50 may be a discrete microprocessor associated with the linear polisher, a PC-based computer linked to the linear polisher, or a remotely located processor or other computing tool in communication with the various portions of the linear polisher over communication lines such as an Ethernet network.

Variations in the force exerted at a particular location during polishing will cause an increase (or decrease) in the pressure being exerted onto the fluid at that location. If base parameters, such as downforce of the wafer, fluid pressure of the fluid from the fluid bearing and pad velocity remain constant, the fluid pressure will typically remain somewhat constant as well. However, if certain polishing parameters are changed, then forces acting on the pad-wafer interface can cause a pressure difference that will be sensed by the pressure sensors 48*a*, 48*b*. Concurrently, a change of polishing parameters will often lead to a change in fluid flow, as measured at the mass flow meter 32, to the fluid platen 30. Also, the roller motor current will vary due to changes in the load on the motor 52 resulting from the changing polishing conditions. Pressure, flow rate and motor current can be used to track process parameters such as pad smoothness and dishing performance. Each of these three parameters can be used on their own, or in combination, to track polisher performance.

Figure 5:
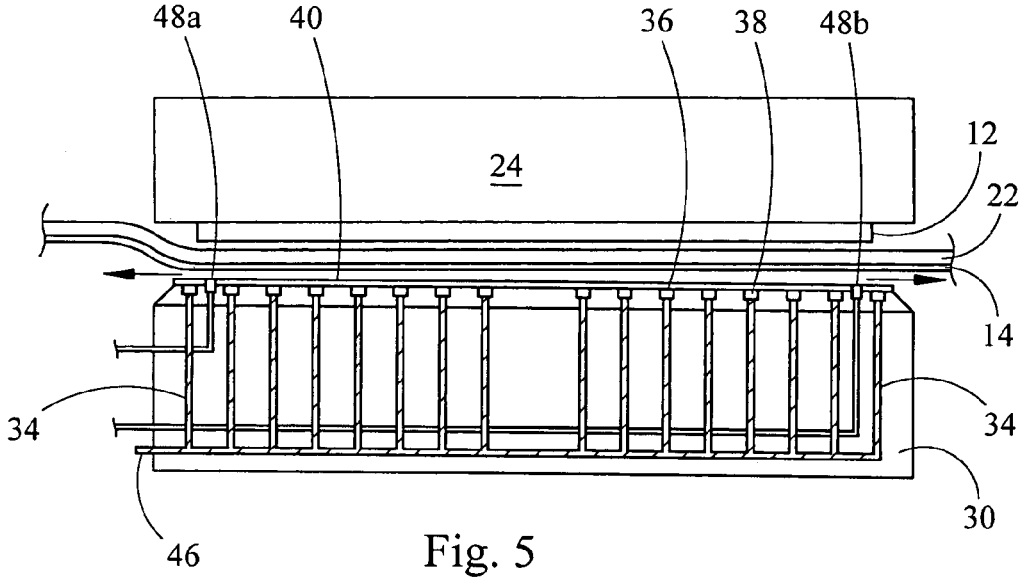
FIG. 5 is a cross-sectional view of the fluid platen of FIG. 2 showing a leading edge of a wafer tilting into the polishing pad toward the fluid platen.

FIG. 5 illustrates one instance where there is a change in the fluid pressure. In the example of FIG. 5, the wafer 12 is shown tilted slightly so as to depress the leading edge of the pad downward towards the sensor 48*a* and pressure decrease at the trailing edge 48*b*. Assuming the other parameters had been kept constant, this slight tilt causes the fluid pressure under the leading edge region to increase. The pressure increase is noted by the leading edge sensor 48*a*. In some instances, the motion of the wafer 12 may cause an increase of fluid pressure at the leading edge and a slight decrease at the trailing edge, or vice versa. Accordingly, depending on the process, some process variations can be detected by a change in the pressure at the leading edge, the trailing edge, or the pressure differential between the leading edge and trailing edge locations.

This monitoring the fluid pressure can be utilized to identify certain process characteristics. One process characteristic that can be tracked using the absolute measured fluid pressure and comparing it to a previously determined desired baseline pressure is pad smoothness. Another process characteristic that can be tracked, by monitoring fluid pressure changes, is an end point condition. During polishing the pad/wafer interface generates a shear force that is counteracted by a gradient in the fluid bearing pressure within the bearing-belt gap. The pressure gradient is generally greatest at the leading edge region of the wafer, as illustrated in the example of FIG. 5, due to a slight tilt of the wafer caused by the shear force.

The shear force at the pad/wafer interface will vary depending on the material being polished and the smoothness of the polishing pad. Because there is a correlation between the smoothness of a polishing pad and shear force at the pad/wafer interface, and because of the correlation between wafer polishing performance and pad smoothness, monitoring the pressure provides a means to determine the pad smoothness. By adjusting the pad smoothness, as for example through pad conditioning, the polishing performance can be monitored in situ and adjusted in situ.

In an embodiment utilizing only pressure to determine pad smoothness, the two pressure sensors 48*a*, 48*b* are utilized. The pressure being monitored may be from the leading edge sensor 48*a* only. Thus, the present invention can be practiced utilizing only one sensor. Although the sensor may be located elsewhere, the preference is to have it at the leading edge. The second sensor 48*b* is utilized in the example of FIGS. 2–5 for providing a fluid pressure response at the trailing edge for comparison purpose with the leading edge sensor. When using two or more sensors, the pressure differential between the sensor locations can be monitored for polishing performance of a given layer. The pressure differential of the sensors could also be used for end point detection, instead of just the leading edge sensor. The use of particular sensor or sensors and the location of such sensor(s) will depend on the polishing process being monitored.

Figure 6:
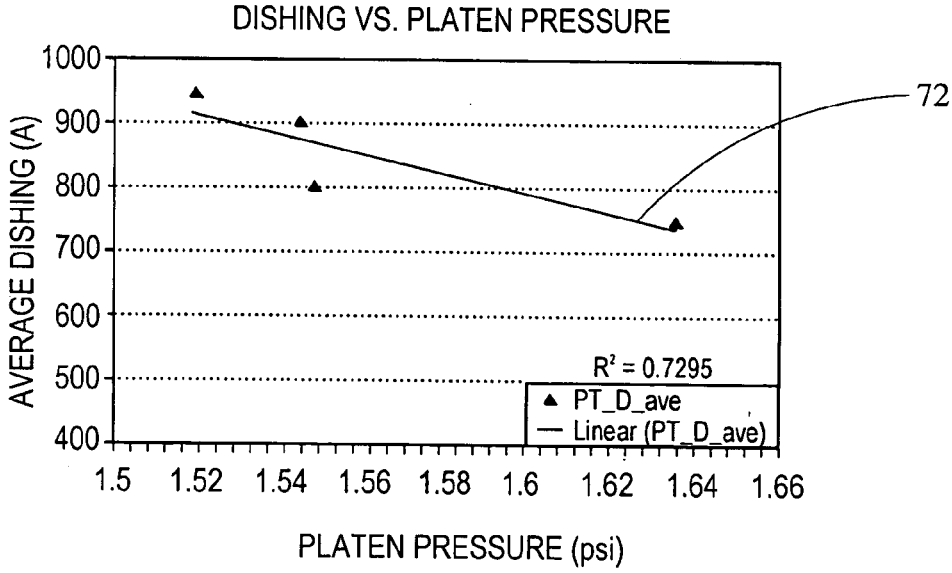
FIG. 6 is a graph showing a relationship of platen fluid pressure and dishing.

FIG. 6 illustrates an example of the relationship between pressure and dishing for a given type of wafer, polishing pad, pad conditioner puck and slurry. The graph of FIG. 6 shows gauge pressure averaged in time over the main processing step, in pounds per square inch (p.s.i.), versus the average dishing in angstroms (Å). The average dishing is measured by examining a representative portion of the wafer and averaging the dishing over that portion of the wafer. The general relationship shown by the interpolated pressure-to-dishing line 72 is that dishing decreases as the pressure increases. Because less dishing can be correlated with a smoother pad surface, the increased pressure may also be interpreted as an increase in pad smoothness. Accordingly, after a preferred value or range of pressures is determined through initial calibration with a patterned wafer or other sample, that value or range may be used by the polisher controller 50 to adjust pad conditioner sweep and force to obtain the desired pressure.

In another embodiment, the system and process may monitor fluid flow to the fluid platen 30 to determine in situ pad smoothness. In this embodiment, the controller 50 monitors information from the mass flow meter 32 while a patterned wafer or other items polished so that a flow rate is recorded. As with the pressure embodiment discussed above, the fluid flow embodiment is implemented by first establishing a baseline measurement to find the fluid flow that yields the desired dishing performance. When the process produces a wafer with the desired level of dishing, the flow information may be used both to prepare other polishing pad and pad conditioner sets of the same type for use with the same type of wafer and to maintain the desired pad smoothness during wafer processing.

In general, a parallel configuration of the wafer being polished to the platen will result in a steady state condition where a fixed fluid pressure being applied to the fluid bearing results in a uniform fluid flow. Deviation from this parallel configuration of wafer and platen will require the mass flow meter to increase fluid flow to maintain a pressure. In other words, in order to balance the forces of the downforce of the wafer against the polishing pad, the pressure provided by the fluid bearing, and the friction force of the wafer against the pad during polishing, and the pressure distribution is non-uniform.

Figure 7:
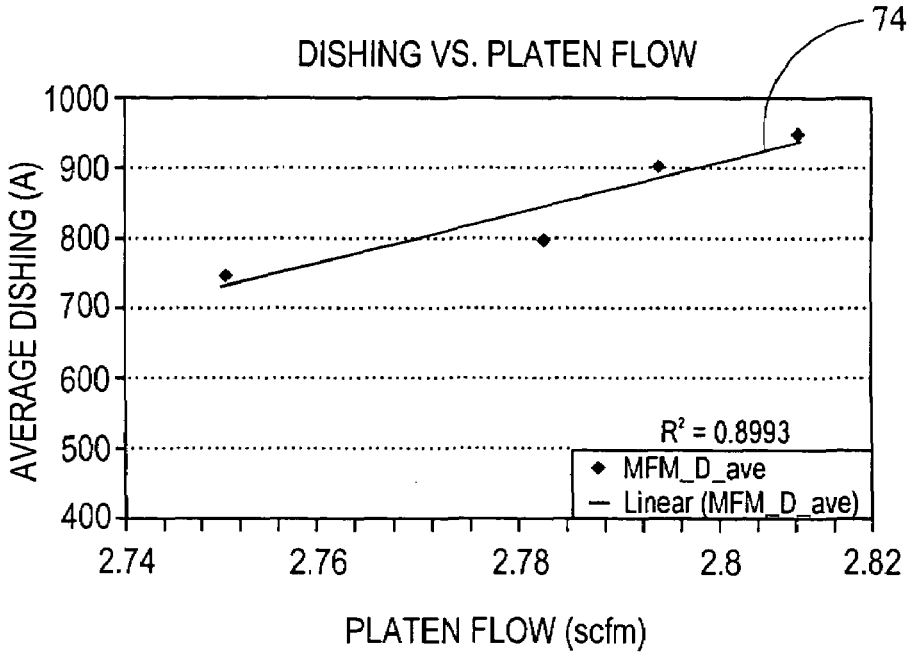
FIG. 7 is a graph showing a relationship of platen fluid flow and dishing.

FIG. 7 illustrates one example of the relationship between fluid flow, as measured at a mass flow meter in standard cubic feet per minute (SCFM), and the resulting average dishing measured on the wafer. The interpolated linear relationship 74 illustrates that dishing increases as fluid flow increases. Thus, a smoother pad results in less friction which decreases fluid flow. Conversely, an increase in fluid flow, just as a decrease in pressure, correlates with poor dishing performance (i.e. an increase in the amount of dishing seen on a wafer). In the same manner as discussed with the pressure embodiment above, after a preferred range of fluid flow is determined through initial calibration with a patterned wafer or other sample, that preferred range may then be used by the polisher controller to compare against in situ measurements so that pad conditioning may then be directed by the controller to maintain pad smoothness to obtain the desired range of fluid flow.

Figure 8:
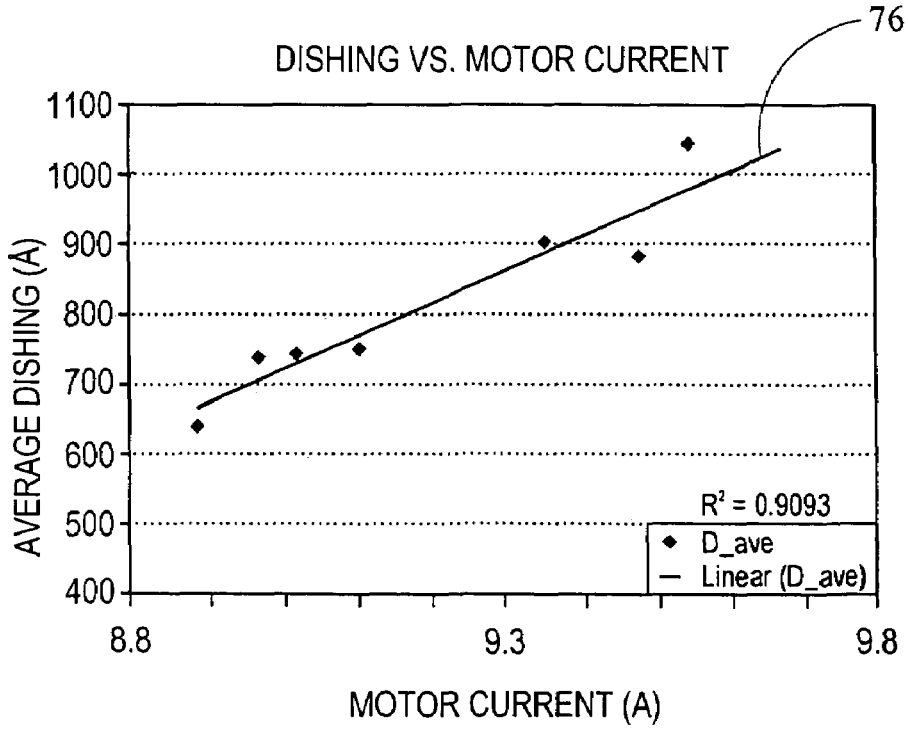
FIG. 8 is a graph showing a relationship of roller motor current and dishing.

In another embodiment, another measurable parameter that may be used to reduce polisher break-in time and dependence on numerous dummy wafers (such as copper slugs) and patterned wafers is motor current. Just as the fluid flow and pressure measurements can be correlated to pad smoothness, and thus dishing performance, measurements of electric motor current at the roller motor have also been found to correlate with pad smoothness/wafer dishing performance. In this embodiment, the roller motor current may be monitored and fed back to the controller 50 for use by the controller in maintaining the proper pad conditioning regimen to maintain the pad smoothness within the preferred operating range. The same type of calibration procedure discussed with respect to the pressure and fluid flow parameters may be used to determine the desired relationship of pad smoothness to motor current. FIG. 8 illustrates an interpolated linear relationship 76 between current (in amps) and the resulting dishing (in angstroms). An increase in motor current can result in an increase in dishing. Thus, as with the fluid flow and pressure embodiments, a CMP process requiring dishing of less than a specific amount can use the motor current to determine when a polishing pad is too rough and apply the appropriate pad conditioner force and time to adjust the pad smoothness.

With reference to any of the pressure, flow, and motor current attributes discussed above, the present system and method takes advantage of one or more of these quantifiable measurements to help reduce costs and time for preparing a pad and a conditioner for optimum planarization performance. Using one or more of the pressure, fluid flow and motor current parameters, a baseline measurement is made on a test wafer, such as a patterned wafer to determine the values of the monitored parameters that give the target dishing performance. The controller is then given instructions to automatically adjust the conditioning parameters in the recipe in order to maintain the desired monitor parameter values. If the monitored parameters stray from the desired values, the controller will then manipulate the pad conditioner to achieve the desired pad smoothness. The controller may accomplish this through application of an algorithm that operates as a function of the monitored feedback parameter(s). The algorithm may cause the controller to automatically manipulate, in one embodiment, the pressure applied by the pad conditioner to the polishing pad. In another embodiment, the algorithm may cause the controller to automatically manipulate the total time the conditioner is applied to the polishing pad.

In other embodiments, specific combinations of two or more of the pressure, fluid flow and motor currents measurements may be combined to optimize the belt smoothness detection. For example, certain mathematical transformations of the three parameters are contemplated. In one embodiment, the parameters of pressure, flow and current are added together to provide a sum that used by the controller to determine changes in the pad conditioning regimen applied in this closed loop process. In other embodiments, it is contemplated that the reference parameter will be the pressure divided by the flow, and in yet other embodiments the motor current may be divided by the pressure multiplied by the flow. Again, the method may be adapted to use only one of the three parameters. Similarly, the system may be configured to only measure and feedback to the controller one of these three linear polisher criteria for use in controlling, in situ, the pad smoothness.

The system and method may be applied to both in situ characterization and control of pad smoothness for a particular set of consumables (i.e. polishing pad and pad conditioner) and to in situ characterization and control of any set of consumables of the same type as the initial set. In other words, once a pad and a conditioner have been characterized in a CMP process for a particular type of wafer, any replacement pad or pad conditioner of the same type (e.g. the same model polishing pad from the same manufacturer) may be introduced into the polisher. The previously determined baseline parameters should result in the same pad smoothness control for the replacement pad and/or pad conditioner. The baseline parameters corresponding to the desired performance level can also be transferred to other polishers of the same type (e.g. same model and manufacturer) as the polisher on which the baseline measurements were made. In this manner, costs savings may be realized through using fewer dummy and patterned wafers on new pad and pad conditioner sets of the same type.

Figure 9:
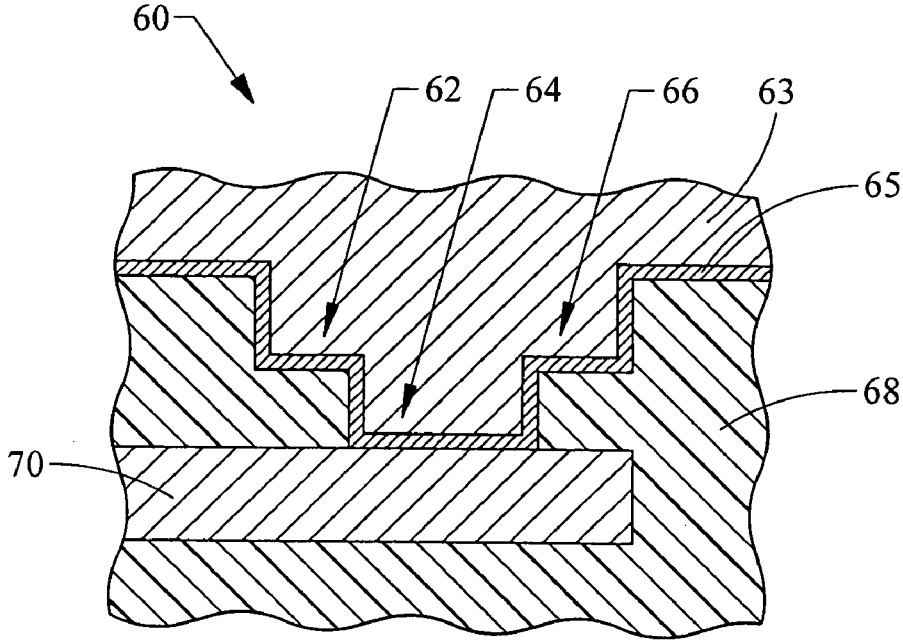
FIG. 9 is a sectional view of a semiconductor device having a dual damascene structure formed in a dielectric layer with a connection to an underlying metal layer in which a barrier layer and a subsequent copper layer fill the trench and via openings.
Figure 10:
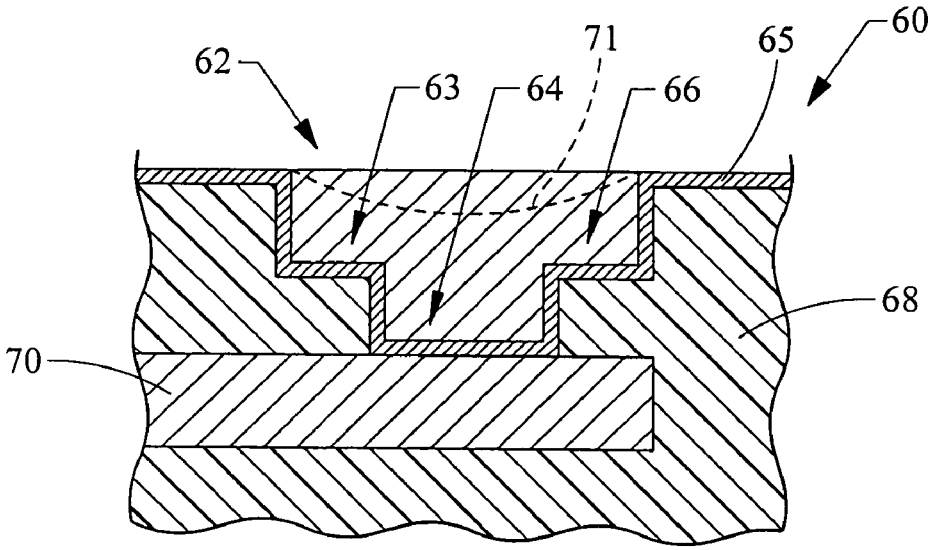
FIG. 10 illustrates the device of FIG. 9 after chemical mechanical polishing has been performed and illustrates the concept of dishing.

FIGS. 9–10 illustrate the concept of dishing that the embodiments described herein are intended to reduce by way of an example CMP process on a dual damascene structure. In FIG. 9, a portion of a semiconductor device 60 having a dual damascene structure 62 is shown prior to planarizing a copper 63 and a barrier 65 layer that have been deposited. The dual damascene structure 62 is comprised of a via opening 64 and a contact trench opening 66 and is formed in a dielectric layer 68, which is typically referred to as an ILD. The via 64 is utilized to connect to an underlying metal layer 70.

As shown in FIG. 10, CMP is utilized to planarize the surface of the structure, so that the copper 63 remaining is only within the via and trench regions. The CMP planarization is achieved by linear planarization using the process described herein. Ideally, the pad smoothness is controlled in situ as discussed herein, copper and the barrier material are polished away, thereby exposing the underlying upper surface of the ILD with little or no dishing. Unacceptable dishing can occur when a polishing pad is not of the proper smoothness. Dishing refers to over-polishing a wafer so that too much of a material deposited on a wafer, such as the copper filling the via 64 and trench 66 openings, is removed leaving a concave or "dish"-shaped region. In FIG. 10, the dotted line 71 indicates what could result if dishing occurs and portions of the copper residing within the trench region 66 are removed.

Although the embodiments discussed above relate to monitoring CMP processing in situ to obtain the characteristics of the wafer polisher parameters representative of a desired polishing performance, to maintaining the polisher parameters in this desired operating region, and to replicating these polishing parameters on different sets of consumables in polishers applying the same process to the same type of wafer or other material, the pressure, fluid flow and/or motor current parameters may also be used to assist in end-point detection. In order to provide for an end-point detection of an on-going process, the controller 50 of the polisher 10 may be configured to recognize a characteristic change in one or more, or a combination of, these parameters rather than the absolute value of the parameter. When one material is polished away during CMP to reveal an underlying material of different composition, thus indicating the end point of the polishing process, the shear forces change. The change in the shear forces causes a change in the linear polisher parameters. This change may be detected by the controller via the feedback information from the pressure sensor, the mass flow meter and/or the roller motor. Thus, a polishing end point can be detected by calibrating the controller to identify the appropriate change and then to monitor the desired parameter or parameters to identify the change on subsequent wafers. For end-point detection, a relative change in the monitored parameter is significant such that a differential in the parameter measurement may be sufficient to identify an end-point. In contrast, an absolute parameter reading, or range, is monitored for pad smoothness.

A system and method for monitoring the pressure, fluid flow and/or motor current to characterize, monitor and maintain a desired pad smoothness has been described. Although pressure, fluid flow, and electric motor current are specifically noted, it is contemplated that other types of linear polisher parameters may be adapted for measuring the shear force in situ. Additionally, although the embodiments above are described with reference to performing CMP on a semiconductor wafer, the invention can be readily adapted to polish other materials as well, such as glass, metal substrates or other semiconductor substrates, including substrates for use in manufacturing flat panel displays.

An advantage of the system and method discussed herein is the potential for reduction of costs in characterizing a polishing process. In order to initially characterize a polishing process, a patterned wafer and/or wafer blanks may be used on a polisher and polished until a desired result is achieved. Once the desired result is achieved, the parameters of the polishing process, such as fluid flow rate, pressure, and motor current, are recorded so that one or more of the parameters may be monitored by the polisher. When one or more parameters drift away from the ideal parameters, the polisher can then automatically apply a conditioner to bring that parameter into the desired range. The initial parameter measurement on a patterned wafer will depend on the underlying material being used. Once baseline measurement is experimentally obtained, the best parameter values can be utilized in a manufacturing setting to monitor an on-going process to maintain pad smoothness. Additionally, the same parameters can be used on other polishers. Accordingly, in-situ pad smoothness can be characterized and maintained, thereby reducing dishing, through the use of pressure, fluid flow and motor current, alone or in various combinations. Furthermore, the system and method helps to maximize the lifetime of the polishing pad and conditioner while maintaining wafer polishing performance.

It is therefore intended that the foregoing detailed description be regarded as illustrative rather than limiting, and that it be understood that it is the following claims, including all equivalents, that are intended to define the spirit and scope of this invention.

We claim:

1. An apparatus for in situ measurement of polishing pad smoothness comprising:

a belt movably mounted on at least one roller, wherein a roller motor rotatably drives the at least one roller;

a platen disposed underneath the belt, the platen configured to dispense a fluid bearing between the platen and the belt, the belt comprising a polishing pad positioned on a side of the belt facing away from the platen;

a flow meter in communication with a fluid supply line connected with the platen, the flow meter monitoring a flow rate of fluid to the platen;

a sensor in communication with the fluid bearing to measure a pressure change of the fluid while a material is polished; and a controller in communication with at least one of the sensor, the flow meter or the roller motor, the controller operative to monitor a pad smoothness during a wafer polishing process based on receipt of pad smoothness information at the controller, the pad smoothness information comprising at least one of a roller motor current sensed at the roller motor, a fluid flow rate sensed at the flow meter or a pressure sensed at the fluid bearing.

2. The apparatus of claim 1, further comprising a pad conditioner operatively engageable with the polishing pad, and wherein the controller is configured to control the pad conditioner in response to the monitored pad smoothness.

3. The apparatus of claim 2, wherein the controller is configured to maintain a desired pad smoothness by monitoring the pad smoothness information and applying the pad conditioner to the polishing pad until the pad smoothness information falls within a predetermined range indicative of the desired pad smoothness.

4. The apparatus of claim 3, wherein the pad smoothness information comprises only one of the roller motor current, the fluid flow rate or the pressure.

5. The apparatus of claim 3, wherein the pad smoothness information comprises at least two of the roller motor current, the fluid flow rate or the pressure.

6. The apparatus of claim 1, wherein said fluid bearing dispenses a liquid.

7. The apparatus of claim 1, wherein said fluid bearing dispenses a gas.

* * * * *